US007422359B1

(12) United States Patent
Zimmerman

(10) Patent No.: US 7,422,359 B1
(45) Date of Patent: Sep. 9, 2008

(54) METHOD OF MIXING CEMENT AND WATER FOR CONCRETE PRODUCTION

(75) Inventor: Harold M. Zimmerman, Ephrata, PA (US)

(73) Assignee: Zimmerman Industries, Inc., Ephrata, PA (US)

( * ) Notice: Subject to any disclaimer, the term of this patent is extended or adjusted under 35 U.S.C. 154(b) by 0 days.

(21) Appl. No.: 11/870,987

(22) Filed: Oct. 11, 2007

Related U.S. Application Data

(62) Division of application No. 10/786,183, filed on Feb. 25, 2004, now Pat. No. 7,281,839.

(60) Provisional application No. 60/450,570, filed on Feb. 28, 2003.

(51) Int. Cl.
*B28C 5/08* (2006.01)

(52) U.S. Cl. ..... 366/3; 366/13; 366/64

(58) Field of Classification Search ..... 366/3, 366/13, 64
See application file for complete search history.

(56) References Cited

U.S. PATENT DOCUMENTS 3,310,293 A 3/1967 Zimimerman
3,326,536 A * 6/1967 Zingg et al. ..... 366/17
3,502,305 A * 3/1970 Grun ..... 366/317
4,239,396 A * 12/1980 Arribau et al. ..... 366/2
4,406,548 A 9/1983 Haws
4,436,430 A * 3/1984 Mayer et al. ..... 366/13
4,439,042 A * 3/1984 Bertoglio ..... 366/154.2
4,834,542 A * 5/1989 Sherwood ..... 366/21
5,322,357 A * 6/1994 Mazer ..... 366/181.1
5,599,102 A * 2/1997 Hamada et al. ..... 366/178.1
5,660,465 A * 8/1997 Mason ..... 366/3
5,775,803 A * 7/1998 Montgomery et al. ..... 366/2
5,813,754 A * 9/1998 Williams ..... 366/6
5,904,419 A * 5/1999 Arribau ..... 366/167.2
6,019,498 A * 2/2000 Hamada et al. ..... 366/178.1
6,435,707 B1 * 8/2002 Mori et al. ..... 366/171.1
6,974,246 B2 * 12/2005 Arribau et al. ..... 366/164.6
7,281,839 B1 * 10/2007 Zimmerman ..... 366/64

* cited by examiner

*Primary Examiner*—Tony G Soohoo
(74) *Attorney, Agent, or Firm*—Miller Law Group, PLLC

(57) ABSTRACT

A high-speed turbine mixer combines water and cement into a pre-mixed cement paste that is added to aggregates to create a concrete mix. The turbine mixer includes a housing that cooperates with an auger to move dry cement into a mixing chamber where water is added. A mixing plate rotates at high speed to break up water and cement into small particles that enhances the hydration of the cement and increases the air content in the resultant cement paste. The cement paste is then conveyed to a mixing auger to be combined with aggregates to create a concrete mix. The mixing plate divides the mixing chamber to force the mixing water and cement particles to pass through a circumferential annular opening past agitating fins. Admixtures can be added to the cement as a powder or to the water as a liquid for incorporation into the cement paste.

20 Claims, 8 Drawing Sheets

Fig. 4
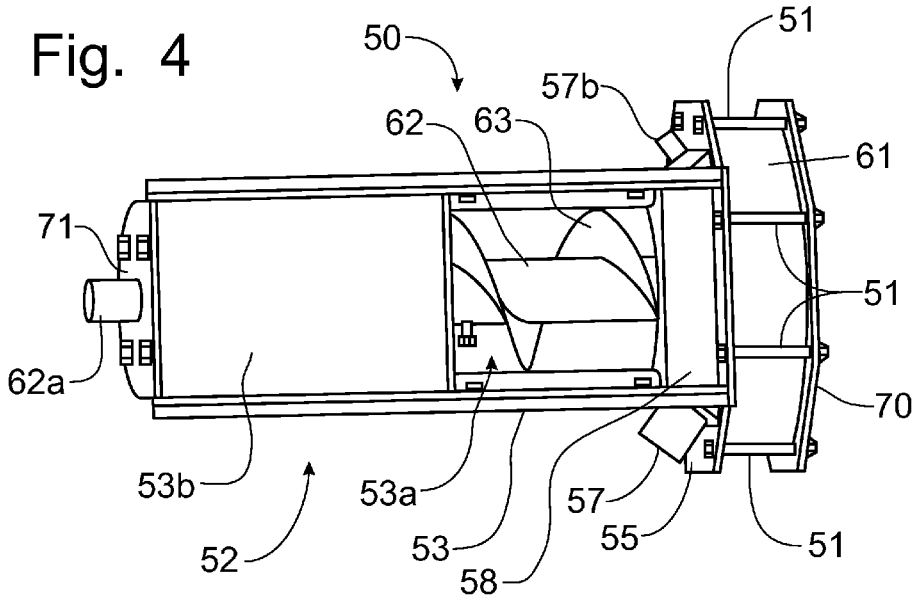
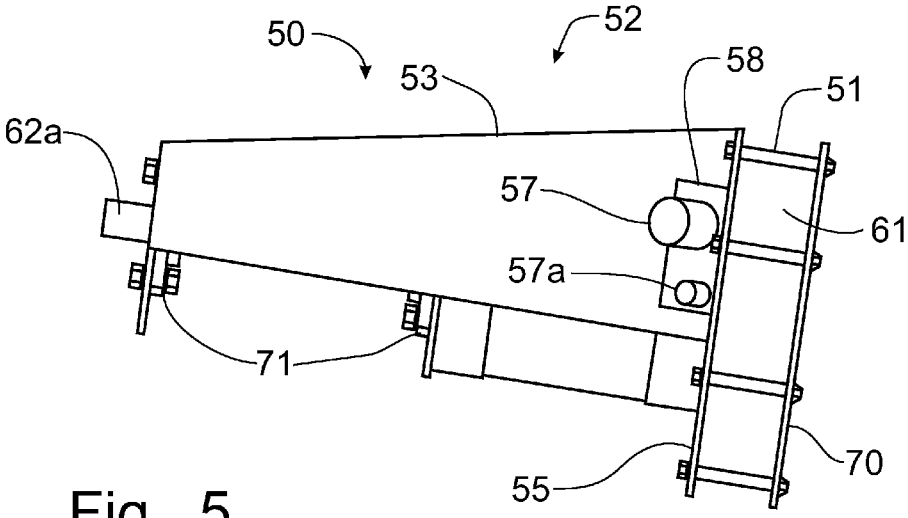
Fig. 5

Fig. 6
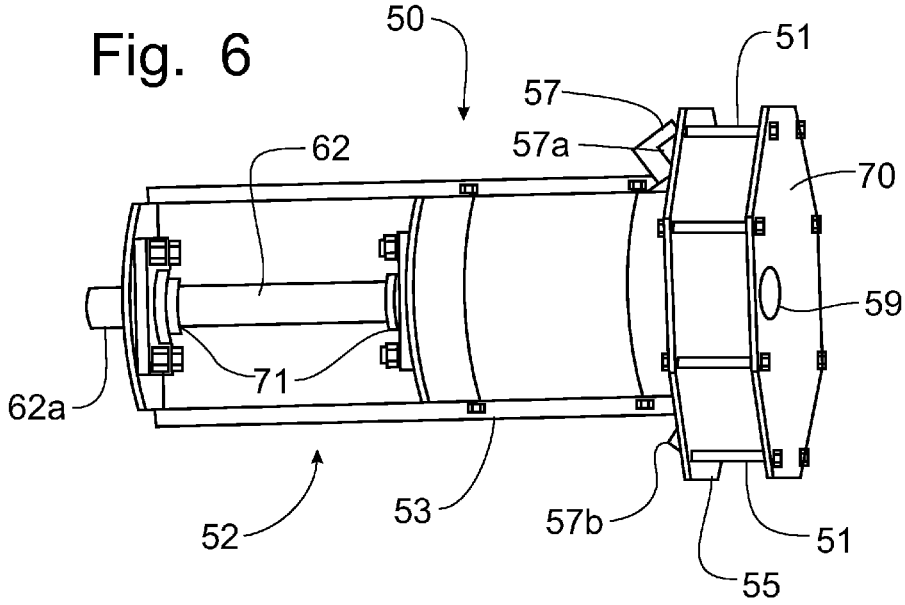
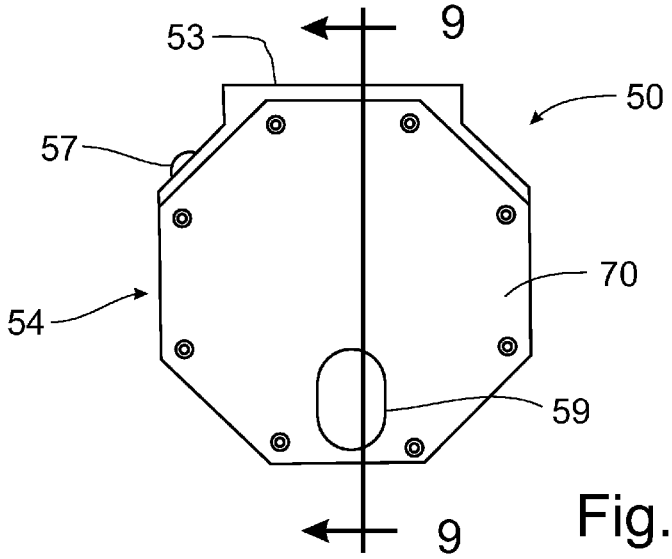
Fig. 7

METHOD OF MIXING CEMENT AND WATER FOR CONCRETE PRODUCTION

CROSS-REFERENCE TO RELATED APPLICATIONS

This application is a division of U.S. patent application Ser. No. 10/786,183, filed Feb. 25, 2004, now U.S. Pat. No. 7,281,839, granted Oct. 16, 2007, and claims domestic priority of U.S. Provisional Patent Application Ser. No. 60/450,570, filed Feb. 28, 2003, the contents of which are incorporated herein by reference.

BACKGROUND OF THE INVENTION

The present invention relates generally to an apparatus to mix concrete and, more particularly, to a turbine cement/water mixing apparatus for premixing a cement slurry for use in the production of concrete.

Concrete trucks, such as is described in U.S. Pat. No. 3,310,293, issued to Harold M. Zimmerman on Mar. 21, 1967, and U.S. Pat. No. 4,406,548, issued to Paul M. Haws on Sep. 27, 1983, carry supplies, such as aggregate, cement and water, in discrete hoppers from which the supplies are drawn in predetermined ratios to be deposited in a mixing auger apparatus where the combined supplies are mixed and turned into concrete to be discharged from the mixing auger externally of the concrete truck. This mixing auger apparatus is formed from a generally semi-circular flexible housing against which a standard pitch, spiral flighted auger works to not only mix the combined supplies, but to convey the combined supplies, and ultimately the created concrete, to the remote discharge end of the auger.

Conventional ready-mix concrete production has utilized a rotatable drum mounted on a truck frame to deliver mixed concrete to a delivery site by discharging the mixed concrete from the elevated, rearwardly directed, central discharge opening of the drum. More recent variations of the conventional concrete mixers have reoriented the drum to position the discharge opening toward the front of the truck, which enables the operator to control the discharge and delivery of the mixed concrete through a front-mounted discharge chute mechanism without leaving the cab of the truck.

Concrete trucks, as described in the aforementioned U.S. Pat. Nos. 3,310,293 and 4,406,548, located the mixing auger apparatus at the rear of the truck to receive the respective supplies fed downwardly and rearwardly thereto. The upward incline of the mixing auger allowed the mixed concrete to be discharged from a slightly elevated position to be delivered through a cooperative discharge chute mechanism. A mere repositioning of the mixing auger apparatus to the front of the truck to enable the forward discharge of the mixed concrete forwardly thereof is not a simple design choice as the operator's cab of the truck prevents the relocation of the mixing auger apparatus to the opposing front position. The forwardly delivering concrete truck must be capable of delivering mixed concrete at a forward position above the cab of the truck so that a discharge chute mechanism, which must be storable in a transport position above the truck cab out of the line of sight of the operator, can deliver the mixed concrete to the ground forwardly of the truck.

The mobile concrete production system includes a storage tank mounted on the chassis bed which has two longitudinally extending hoppers separated by a common wall. One hopper contains sand, and the other contains gravel or stone. A central, longitudinal conveyor operatively mounted along a bottom trough common to both hoppers receives sand and stone and delivers the materials to a rear discharge end. Also, the system includes a separate cement hopper as well as a separate water tank mounted on the chassis. Cement is dispensed in the desired proportion by a metering mechanism from the cement storage hopper into the discharging sand and stone and all three ingredients are then delivered into a elongated mixing trough mounted on the rear of the chassis. Water is added with the materials at the entrance and the ingredients are mixed into concrete in the trough before being discharged from the trough at the job site.

Many advantages and benefits are enjoyed by persons who employ the mobile concrete system in their concrete production business. An important one is that the system permits the formulation and delivery of relatively continuous amounts of concrete which can be used to fulfill orders where only small quantities of concrete are needed, thus obviating the need for taking such quantities from a single large pre-mixed batch. Since only a small portion of the system, the mixing trough, is utilized for mixing the concrete, it can be quickly and easily cleaned after completion of a "mixing" or production operation. Equally important, since the mixing of the concrete is performed "on site", selective variation of the ingredients of the mixture can be readily accomplished and the water content of the mixed concrete can be easily controlled. Finally, in the mixing trough, a positive mechanical mixing action at a desired rate is performed to assure a uniform dispersal of all the ingredients of the concrete mix.

The incorporation of cement into a concrete production system, whether a ready-mix batch system or a mobile system, typically involves the mixing of dry cement with the aggregate and water until the mixture is homogenous. Admixtures are often added to the mixture to accomplish desired functions, such as changing the set time, increasing temperature, adding color to the concrete mixture, incorporating air into the mixture, etc. In both batch and mobile concrete production systems, a certain percentage of individual cement particles remain unhydrated despite an aggressive mixing action and despite the incorporation of additives to improve the hydration of the cement. A more thorough hydration of the individual cement particles can lead to increase strength and reduce concrete set times.

Some concretes produced by the mobile production system encounters a phenomenon commonly referred to as "false set", which can be described to as a premature stiffening of the concrete. This phenomenon is typically solved through the use of a specially formulated cement product that is more expensive than the cement used in batch production systems. Accordingly, the unit cost of mobile production concrete is higher than conventional batch production concrete. It would be desirable to provide a process that would improve the mobile production of concrete to permit the use of a conventional cement formulation without incurring the false set problems.

The production of concrete, whether via a mobile concrete system or a ready mix system, typically involves the placement of dry cement, dry aggregate and dry sand into a mixing apparatus where water is added to hydrate the cement and create concrete. Admixtures to entrain air, to increase strength, to increase hydration, to die the concrete, etc. are added to the mixture during the mixing operation. Full hydration of the cement is such operations is not possible, thus chemical additives for the produced concrete is normal.

It would, therefore, be desirable to provide an apparatus and an improved process for producing concrete by effecting a substantially complete hydration of the cement particles.

SUMMARY OF THE INVENTION

It is an object of this invention to overcome the disadvantages of the prior art by providing a turbine mixer to pre-mix water and cement before delivery to the mixing auger of a mobile concrete production machine.

It is another object of this invention to improve the hydration of cement particles in the production of concrete.

It is an advantage of this invention that the improved hydration of cement particles increases the compressive strength of concrete.

It is a feature of this invention that a high speed, rotating turbine blade breaks up cement and water particles into small sizes for improved mixing and hydration of the cement particles.

It is another advantage of this invention that the pre-mixing of water and cement with a high speed turbine mixing apparatus reduces bleed water in concrete.

It is another feature of this invention that the mixing action induced by the high speed turbine mixer increases air content in the resultant cement paste.

It is still another advantage of this invention that the increased air content in the resultant cement paste will reduce and possibly eliminate the need for air entrainment admixtures normally added to concrete mixes.

It is yet another advantage of this invention that the improved mixing action to create a pre-mixed cement paste from water and cement before being added to aggregates may eliminate false sets in concrete.

It is still another feature of this invention that the turbine mixing apparatus permits a more efficient addition of admixtures by permitting the incorporation of the admixture, whether powder or liquid, into the mixing process in the turbine mixer.

It is still another object of this invention to provide a method of producing concrete that will provide a higher quality concrete product.

It is yet another feature of this invention that the method of producing concrete includes the pre-mixing of water and cement by a high-speed turbine mixer to create a cement paste before being added to aggregates to create a concrete mix.

It is a further advantage of this invention that the pre-mixing of cement and water before being added to aggregates will eliminate the dispersion of cement dust into the atmosphere.

It is still a further advantage of this invention that the increased air content incorporated into the pre-mixed water and cement by the high-speed turbine mixer enhances the ability of the resultant concrete mix to be pumped and placed on site.

It is yet another object of this invention to provide a method of creating a more homogeneous and fluid concrete mix through the high speed pre-mixing of water and cement before being added to aggregates.

It is a further object of this invention to provide a turbine mixer for the pre-mixing of water and cement that is durable in construction, inexpensive of manufacture, carefree of maintenance, facile in assemblage, and simple and effective in use.

It is still a further object of this invention to provide an improved method of making concrete that provides a higher quality finished concrete product that can be incorporated into any type of configuration of concrete mixer or mixing apparatus.

These and other objects, features and advantages are accomplished according to the instant invention by providing a high-speed turbine mixer that combines water and cement into a pre-mixed cement paste that is added to aggregates to create a concrete mix. The turbine mixer includes a housing that cooperates with an auger to move dry cement into a mixing chamber where water is added. A mixing plate rotates at high speed to break up water and cement into small particles that enhances the hydration of the cement and increases the air content in the resultant cement paste. The cement paste is then conveyed to a mixing auger to be combined with aggregates to create a concrete mix. The mixing plate divides the mixing chamber to force the mixing water and cement particles to pass through a circumferential annular opening past agitating fins. Admixtures can be added to the cement as a powder or to the water as a liquid for incorporation into the cement paste.

BRIEF DESCRIPTION OF THE DRAWINGS

The advantages of this invention will be apparent upon consideration of the following detailed disclosure of the invention, especially when taken in conjunction with the accompanying drawings wherein:

FIG. 4 is a top plan view of the turbine mixer incorporating the principles of the instant invention;

FIG. 5 is a right side elevational view of the turbine mixer depicted in FIG. 4;

FIG. 6 is a bottom plan view of the turbine mixer depicted in FIGS. 4 and 5;

FIG. 7 is an end view of the discharge end of the turbine mixer depicted in FIGS. 4-6;

DETAILED DESCRIPTION OF THE PREFERRED EMBODIMENT

Figure 1:
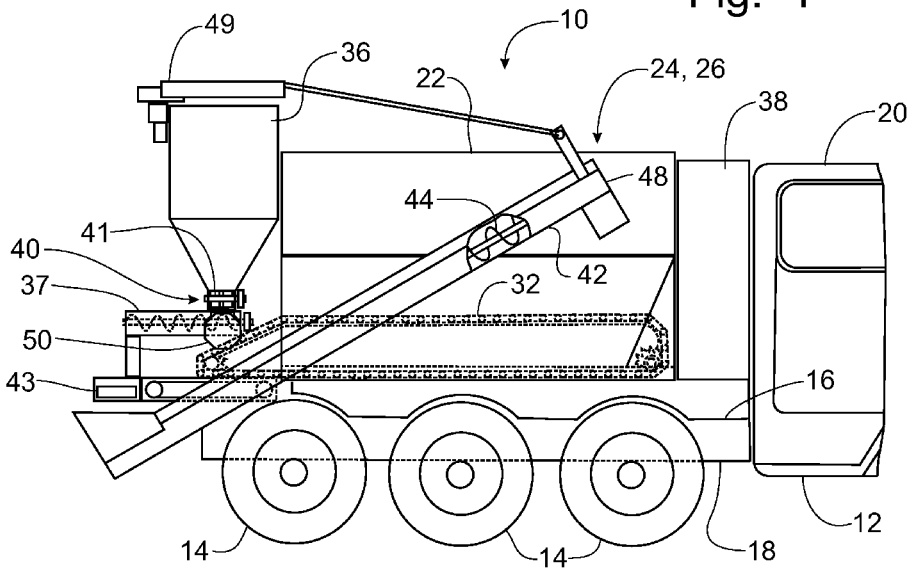
FIG. 1 is a schematic partial side elevational view of a representative mobile concrete production machine.
Figure 2:
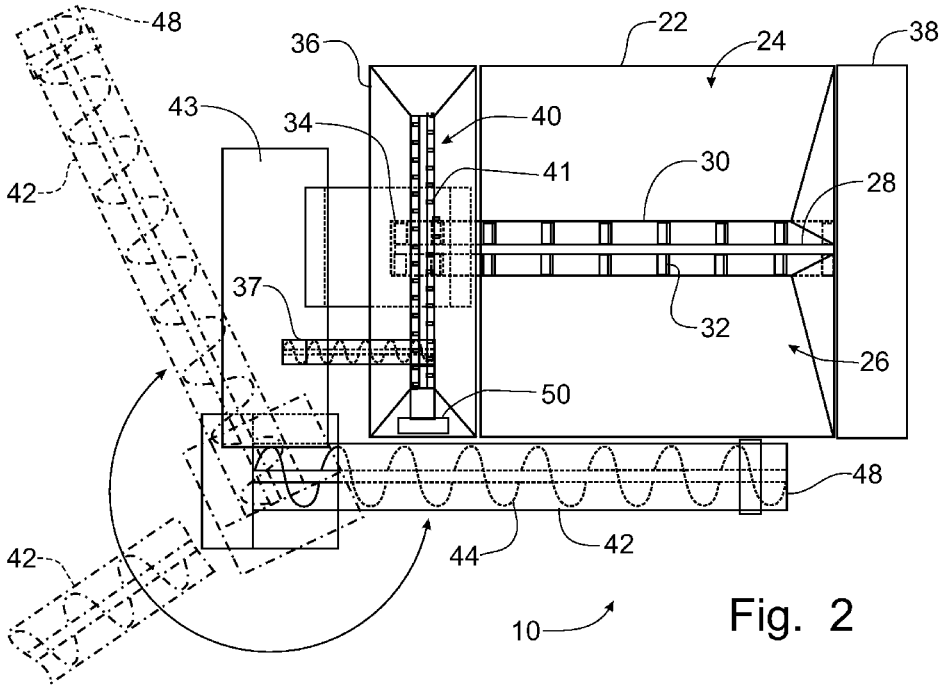
FIG. 2 is a schematic top plan view of the representative mobile concrete production machine shown in FIG. 1 with portions broken away to depict the drag conveyors within the respective hoppers, the movement of the mixing auger being shown in phantom.
Figure 3:
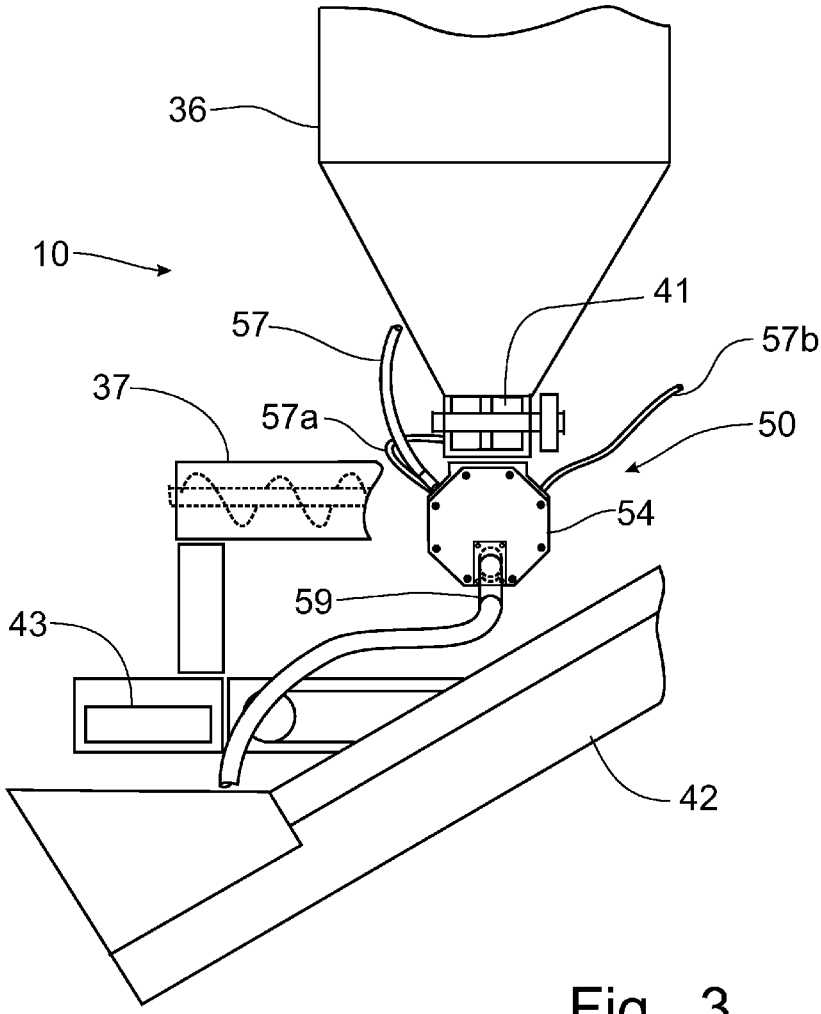
FIG. 3 is an enlarged schematic elevational view of the rear of the mobile concrete production machine shown in FIG. 1 to depict the location of the turbine mixer incorporating the principles of the instant invention.
Figure 8:
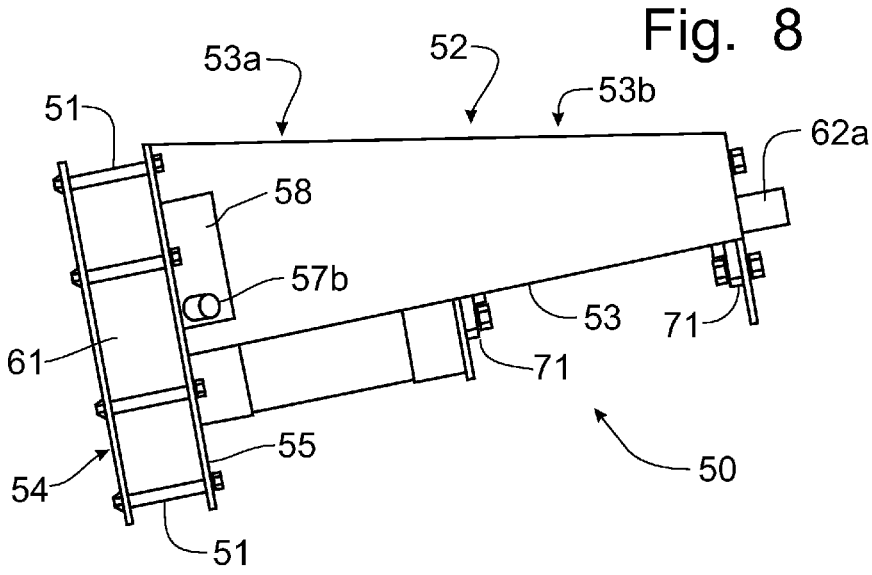
FIG. 8 is a left side elevational view of the turbine mixer depicted in FIGS. 4-7.

Referring now to FIGS. 1-3, a representative mobile concrete mixer can best be seen. Left and right references are used as a matter of convenience and are determined by standing at the rear of the concrete mixer and facing the forward end, where the operator's cab is positioned, in the normal direction of travel. While the mobile concrete production system is shown and described in the drawings to explain the nature of the invention, one of ordinary skill in the art will readily understand that the principles of the instant invention are not limited to the mobile concrete production system and will be readily applicable to conventional ready mix, or batch operations as well. The turbine mixer shown in the drawings and described below will be applicable to any form of concrete production. Accordingly, a representative mobile concrete production system is shown in the drawings.

The mobile concrete production mixer 10 is provided with a chassis 12, made mobile by tandemly arranged pairs of rear wheels 14 and a pair of front wheels (not shown). The chassis 12 has a bed 16 formed by longitudinally extending channels 18, suitably interconnected by spaced transverse channels (not shown), and a cab 20 mounted at the forward end of the bed. A source of power, such as an engine (not shown) is suitably mounted on the chassis 12 at the front of the cab 20 for driving, preferably, the rear pairs of wheels 14.

The representative concrete production system 10 includes a storage tank 22 mounted on the chassis bed 16 which has two longitudinally-extending hoppers 24,26 separated by a common wall 28 and having a common bottom trough 30. One hopper 24 contains fine aggregates, such as sand, and the other hopper 26 contains coarse aggregates, such as gravel or stone. Mounted along the common bottom trough 30 of the hoppers is the aggregate conveying apparatus 32. The conveying apparatus 32 receives sand and stone and delivers these materials to a rear discharge end 34 where a rearward cross-conveyor 43 receives the aggregates. Also, this representative concrete production system 10 includes a separate cement hopper 36 mounted transversely across the rear of the chassis bed 16 as well as a separate water tank 38 mounted on the bed 16 between the forward end of the storage tank 22 and rear side of the cab 20. Cement is dispensed in the desired proportion from the hopper 36 by a metering apparatus 40 in the form of a drag conveyor 41. In this representative prior art arrangement for a mobile concrete production system, the dispensed cement is delivered into the sand and stone aggregates being conveyed on a cross conveyor 43 by a delivery conveyor 37 receiving the dry cement from the metering mechanism 40 for delivery into an elongated mixing auger 42.

The conventional mixing auger 42 mixes the ingredients into a concrete mixture after water is added thereto from the water tank 38. Therefore, the concrete is mixed by the auger mechanism 44 at the job site just prior to being discharged from a terminal end 48 of a trough 45 of the mixing auger 42. The mixing auger 42 can be mounted at a rear corner of the chassis bed 16 or at a central part of the chassis bed, depending on the arrangement of the components. The mixing auger 42 can be pivoted into a storage position out of the way during transport (shown in solid lines in FIGS. 1 and 2) and a range of dispensing positions (shown in phantom in FIG. 2) through a hydraulic mechanism 49.

A batch, or ready-mix, concrete production system is accomplished in generally the same manner as that described above, except that the components of sand and stone aggregates, cement and water are weighed and combined in a large batch, whether pre-mixed at the batch plant or mixed in the delivery vehicle, instead of being metered into a mixing auger and discharged therefrom, as is described above with respect to the mobile concrete production system. Irrespective of the manner in which concrete is produced, the hydration of the cement particles is accomplished through the mixing action when combining the cement and water with the aggregates.

Referring now to FIGS. 3-11, the details of a turbine mixing apparatus 50 incorporating the principles of the instant invention can best be seen. The utilization of a turbine mixer 50 in the representative mobile concrete production system 10 revises the above description of the conventional mobile concrete production mixer 10 in that the metering mechanism 40 will not dispense cement onto the cross conveyor 43, but instead directly into the turbine mixer 50, as will be described in greater detail below. In the embodiment of the mobile concrete mixer 10 shown in FIGS. 1-3, the mixing auger 42 is positioned at the rear of the mixer 10 and is preferably of the flexible configuration described in greater detail in U.S. Pat. No. 5,486,047, issued on Jan. 23, 1996, to Harold M. Zimmerman, the description of which is incorporated herein by reference.

For batch or ready-mix concrete production operations, the turbine mixer 50 will be positioned to receive the dry cement from a hopper in a metered manner, instead of simply weighing a batch lot of cement for addition to the batch of concrete being mixed. Nevertheless, the operation of the turbine mixer 50 will be generally the same as that described below with respect to the representative mobile concrete production system 10.

Figures 10, 12:
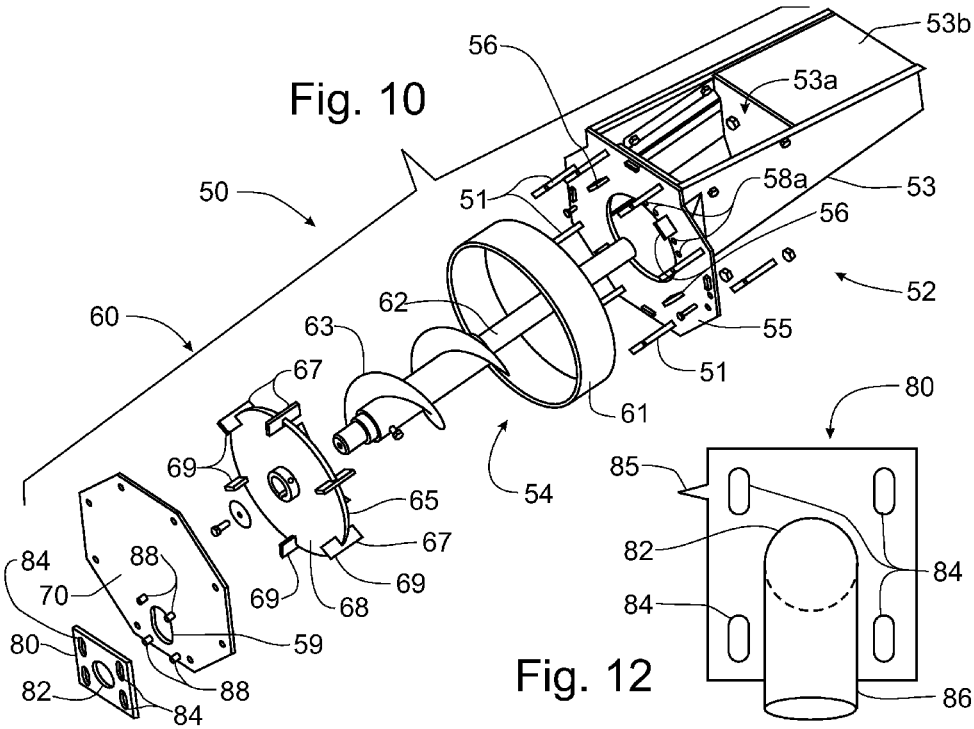
FIG. 10 is an exploded perspective view of the turbine mixer shown in FIGS. 4-9.
FIG. 12 is an enlarged detail view of the adjustable discharge plate mounted on the cover of the turbine mixer.

The turbine mixer 50 includes a housing 52 having a generally tubular portion 53 and a cylindrical mixing housing 54, which could be cast to be integral with the tubular portion 53 or formed as assembled components as reflected in FIG. 10. The mixing housing 54 will have a larger diameter defined by the cylindrical shell 61, than the tubular portion 53. The tubular portion 53 has an inlet opening 53*a* in the top of the housing 52 positioned to be in flow communication with the metering mechanism 40, which is in the form of a drag conveyor 41, to receive the discharge of dry cement therefrom. The turbine mixer 50 also incorporates a mixing assembly 60 that includes an auger 63 mounted on a shaft 62 that is concentrically received within the tubular portion 53 and rotatably supported therein. The mixing assembly 60 further includes a mixing plate 65 affixed to the shaft 62 adjacent the terminus of the auger 63 to be rotatable therewith.

The housing 52 is formed in an elongated configuration with the inlet opening 53*a* at a forward portion in a manner that is open upwardly for receipt of the metered cement from the drag conveyor 41 into the tubular portion 53. Immediately rearward of the inlet opening 53*a* is a panel 53*b* that has the same dimensions as the inlet opening 53*a*. The housing 52 can be mounted on a slide carriage (not shown) that permits the fore-and-aft movement of the housing 52 relative to the metering mechanism 40. Whenever the housing is positioned such that the inlet opening 53*a* is in flow communication with the metering mechanism 40, the dry cement is conveyed into the turbine mixer 50.

On the other hand, when the housing 52 is shifted so that the panel 53*b* is located where the inlet opening 53*a* would otherwise be positioned to receive dry cement, the panel 53*b* closes off the opening in the metering mechanism 40 so that the cement continues on its conventional path into the delivery conveyor 37 and into the mixing auger 42, thus bypassing the turbine mixer 50. Conversely, when the housing 52 is shifted to place the inlet opening 53*a* in flow communication with the conveyor 41, the solid panel 53*b* closes off the opening (not shown) for the discharge of cement to the delivery conveyor 37, thus bypassing the delivery conveyor 37 such that no dry cement will be delivered onto the cross conveyor 43.

Figure 9:
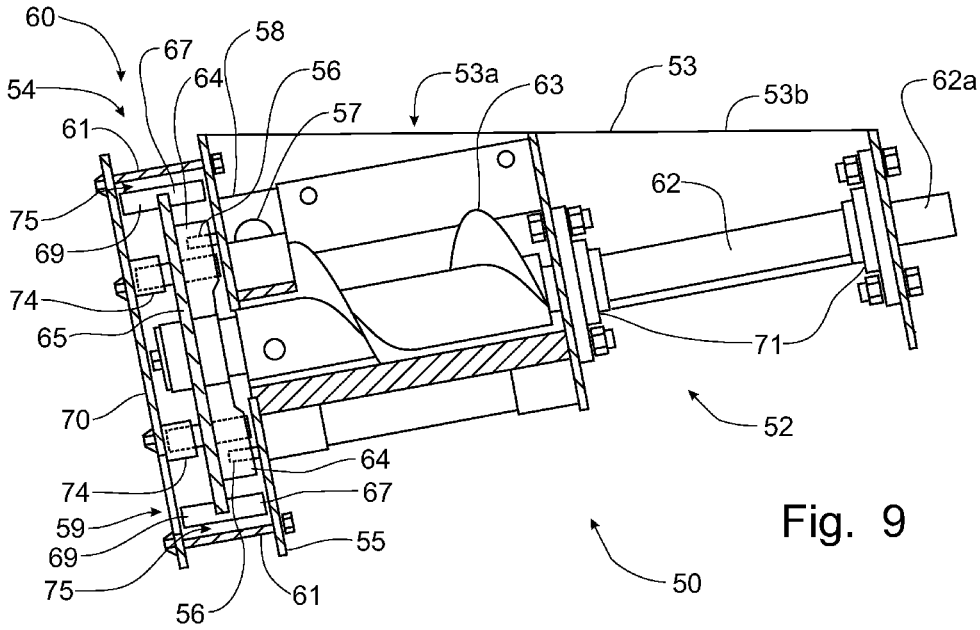
FIG. 9 is a cross-sectional view of the turbine mixer corresponding to lines 9-9 of FIG. 7.

The shaft 62 is rotatably supported by spaced-apart bearings 71 that are mounted in the housing 52 at the distal end of the shaft 62 from the mixing plate 65, as is best seen in FIGS. 6 and 9. The remote end 62*a* of the shaft 62 projects rearwardly from the end of the housing 52 for operable connection to a drive mechanism, preferably in the form of a hydraulic motor (not shown) supported form the end of the tubular portion 53 of the housing 52.

A water inlet port 57 is connected to a conduit (not shown) to deliver water to the mixing housing 54 from the water tank 38 in discrete metered amounts. The water inlet port 57 is preferably located at the end of the tubular portion 53 near the junction between the tubular portion 53 and the mixing housing 54. The water inlet port 57 supplies a flow of water into a water chamber 58 that is generally concentric around the auger 63 so that the water and cement do not become mixed until being introduced into the mixing housing 54.

The mixing assembly 60 is operable to convey the metered cement from the metering mechanism 40 through the tubular portion 53 of the housing 52 by the rotation of the auger 63 working against the confines of the tubular portion 53. Water is introduced into the mixing housing 54 through inlet openings 58*a* through the back wall 55 of the mixing housing, dividing the mixing housing 54 from the tubular housing 53. Dry cement is carried into the mixing housing 54 by the auger 63 where the dry cement is mixed with the water in the manner described below. In an alternative embodiment, the water could be introduced into the end of the tubular housing 53 immediately next to the mixing housing 54; however, this procedure has presented more difficult problems with respect to cleaning of the turbine mixer 50 at the end of day.

Figure 11:
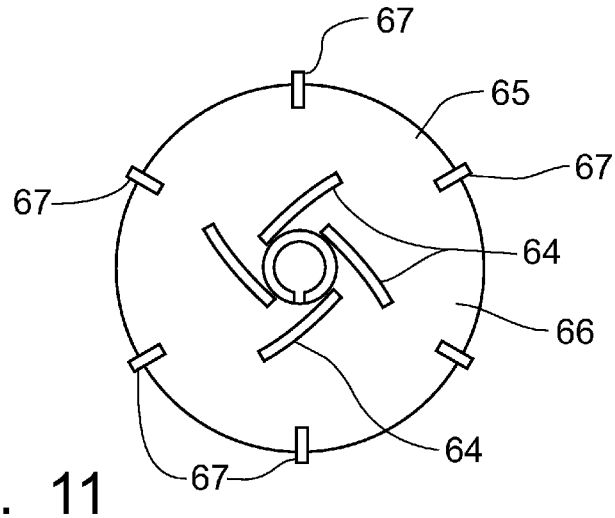
FIG. 11 is an elevational view of the rearward side of the mixing plate.

The vertical back wall 55 of the mixing housing 54 is formed with a plurality of pegs 56 projecting generally perpendicularly from the back wall 55 into the mixing housing 54. As is best seen in FIG. 11, the posterior or rearward face 66 of the mixing plate 65 is formed with radially oriented fins 67 at the outer circumference of the mixing plate 65 located to rotate with the mixing plate 65 around the periphery of the mixing housing 54 radially outwardly from and immediately adjacent to the pegs 56.

As best seen in FIG. 10, the exterior or front face 68 of the mixing plate 65 is also formed with a plurality of radially oriented fins 69 mounted on the outer circumference of the mixing plate 65 in register with the fins 67. Alignment of the fins 67, 69 is not critical to the operation of the mixing plate 65, but provides a convenient configuration for manufacturing the mixing plate 65 and maintains balance for the rotation of the mixing plate 65. The cover plate 70 is also formed with radially oriented blades 74 that are positioned radially inwardly of the rotating fins 69 and immediately adjacent to the path of movement of the fins 69. The proximity of the fins 67, 69 to the corresponding pegs 56 and blades 74 provides for an agitation of the cement and water being conveyed into the mixing housing 54, as will be described in greater detail below.

The mixing plate 65 is also formed with arcuate blades 64 spaced around the circumference of the shaft 62 on the posterior face 66, and optionally on the exterior face 68, to convey, upon rotation of the mixing plate 65, any cement/water mixture radially outwardly toward the outer circumference of the mixing plate 65. The arcuate blades 64 prevent cement mixture from accumulating at the center of the mixing housing 54 without being conveyed out of the mixing housing 54. The arcuate blades 64 are positioned radially inwardly, respectively, of the corresponding pegs 56 on the back wall 55 of the mixing housing 54 and, if positioned on the exterior face 68 of the mixing plate 65, radially inwardly of the blades 74 on the inside of the cover plate 70 to cause a greater agitated mixing of the cement and water before being discharged from the mixing housing 54.

The mixing plate 65 has a smaller diameter than the outer cylindrical shell 61 of the mixing housing 54 to permit the fins 67, 69 to be rotated in close proximity to the outer shell 61 and to provide an annular gap 75 between the mixing plate 65 and the outer shell 61 for the passage of mixed, or partially mixed, cement and water from the posterior side 66 of the mixing plate 65 to the exterior side 69. Thus, the mixing plate 65 divides the mixing housing 54 into an inner chamber and an outer chamber with the mixing plate 65 forming a barrier to the passage of cement and water from the inner chamber to the outer chamber. The annular gap 75 provides the only passageway for the agitated cement and water mixture to reach the outer chamber.

As best seen in FIG. 10, the discharge opening 59 is preferably positioned in the cover plate 70, at a radially outwardly located position, in flow communication with the outer chamber to extract the agitated cement paste (cement/water mixture) from the outer chamber of the mixing housing 54. Preferably, the discharge opening 59 will be an elongated oval to provide some adjustability in the operation of the turbine mixer 50, as will be described in greater detail below. As seen in FIGS. 10 and 12, a slide adjustment plate 80 is mounted on the cover plate 70 in flow communication with the discharge opening 59. The slide adjustment plate 80 is formed with a generally circular discharge opening 82 and slotted mounting holes 84 which are positioned to register with pins 88 fixed to the exterior surface of the cover plate 70.

Thus, the slide adjustment plate 80 is adjustably positionable in a generally vertical manner relative to the discharge opening 59. A seal, such as a rubber gasket (not shown) will be utilized between the slide adjustment plate 80 and the cover plate 70 to prevent the discharged cement slurry from leaking past the slide adjustment plate 80. A discharge nozzle 86 can be connected to the discharge opening 82 for connection to a conduit (not shown) that would convey the ejected cement paste from the turbine mixer 50 to the mixing auger 42 for combining with the aggregates conveyed thereto via the cross conveyor 43 as described above. Preferably, the housing 52 will be mounted at a slightly inclined orientation to facilitate a draining of the mixing housing 54 toward the discharge port 59.

The extent of hydration of the cement particles in the turbine mixer 50 can be controlled through the positional adjustment of the slide adjustment plate 80. Moving the adjustment plate 80 to a position where the discharge opening 82 is in alignment with the radially outward extreme circumference of the discharge opening 59 in the cover plate 70 will retain a minimal amount of cement paste within the periphery of the shell 61 of the housing 54. While the mixing action of the mixing plate 65 at the radially outward alignment position provides hydration results heretofore unknown in the concrete production industry, moving the adjustment plate 80 radially inwardly along the elongated discharge opening 59 such that the discharge opening 82 in the adjustment plate 80 is aligned with the inwardmost circumference of the discharge opening 59 substantially increases the power requirements and the mixing action of the turbine mixer 50.

For a 13-inch diameter mixing housing 54 and a two-inch discharge opening 82 alignable with a three-inch long discharge opening 59, the turbine mixer will require about 15-20 HP to operate. Moving the adjustment plate 80 to align the discharge opening 82 with the radially inwardmost diameter of the discharge opening 59 increases the power requirements by about 50%. Accordingly, the adjustment plate 80 will preferably have an indicator 85 associated therewith to indicate the position of the discharge opening 82 relative to the discharge port 59 to reflect the mixing effect that has been selected by the positioning of the slide adjustment plate 80.

The assembled turbine mixer 50 will have the cover plate 70 bolted to the lugs 51 on the back wall 55 of the mixing housing 54 with the outer cylindrical shell 61 clamped therebetween. The auger 63 is rotatably driven by the hydraulic motor at high speeds, such as about 3000 RPM's, within the tubular portion 53 of the mixing housing 52 to convey dry cement received from the metering mechanism 40 in flow communication with the tubular portion 53 toward the mixing housing 54. The mixing plate 65 is oriented internally of the mixing housing 54 and divides the mixing housing 54 into inner and outer chambers with the discharge port 59 in flow communication with the outer chamber such that the cement/water mixture has to pass through the annular gap 75 between the mixing plate 65 and the cylindrical outer shell 61 to be discharged from the mixing housing 54.

The fins 67, 69 on the opposing faces 66, 68 of the mixing plate 65 cooperate in high speed rotation with the pegs 56 on the back wall 55 of the mixing housing 54 and, respectively, with the blades 74 on the posterior surface of the cover plate 70 to agitate the cement and water being conveyed into the mixing housing 54 into a fluid, homogeneous mixture that is conveyed from the housing 52 through the conduit (not shown) to the mixing auger 42. As a result, a greater proportion of the individual cement particles become hydrated and air becomes mixed into the cement water slurry mixture before being conveyed to the mixing auger 42. By breaking up the cement and water particles through the agitating action of the turbine mixer 50, the chemical reaction between the cement and the water has an increased efficiency. Since a greater proportion of the cement particles are hydrated, the compressive strength of the finished concrete product from the mixing auger 42 will be higher. Furthermore, the bleed water in concrete as the concrete mixture is setting is reduced due to the higher proportion of hydration of the individual cement particles.

The operation of the turbine mixer 50 breaks up the dry cement into particles that are smaller in size than the water droplets that are created by the insertion of the water through the inlet openings 58*a* and the engagement thereof by the mixing plate 65. As a result, the atomized cement particles become infused into the water droplets to create a greatly hydrated mixture of cement and water, a hydration action heretofore unknown in the concrete production industry.

One skilled in the art will recognize that the location of the turbine mixer 50 is not limited to being at the rear of the mobile concrete mixer 10, as is depicted in FIG. 3, but may be located anywhere that dry cement can be conveyed into the tubular portion 53 of the housing 52 and the final cement and water slurry mixture can be conveyed to the mixing auger 42.

The broad aspects of the instant invention relate to the high speed mixing of cement and water, as well as the pressure caused by the mixing, before being introduced into the mixing operation for combining the cement/water slurry with coarse and fine aggregate to produce a final concrete mixture. Such high speed agitated mixing action breaks the cement particles into a fine condition to be mixed with substantially atomized water to effect hydration of a high proportion of the cement particles heretofore unknown in the art of concrete production.

The dropping of the dry cement into the tubular portion 53 of the mixing housing 52 keeps the dry cement product from being exposed to the atmosphere, thus eliminating, or at least substantially reducing, the amount of cement dust that is released to the atmosphere during the production of concrete in a mobile concrete production system. Since the mixing action of the cement and water within the turbine mixer 50 entrains air into the cement/water slurry mixture, fewer requirements for air entrainment admixtures would likely be needed. The highly agitated mixing action created by the turbine mixer 50 should reduce or eliminate the false set phenomenon by increasing the mixing time and the hydration of the individual cement particles in the cement/water slurry. Accordingly, substantially any type of cement can be used in the operation of a mobile concrete production system.

The provision of the turbine mixer 50 allows for a more efficient use of admixtures for concrete. Adding a port 57*a* in communication with the water chamber 58 for the introduction of liquid admixtures into the housing 52 will permit the complete mixing of the admixture with the cement/water slurry mixture before being introduced into the mixing auger 42. The addition of a color dye into the concrete mixture through an additional port 57*b* can also be introduced into the turbine mixer 50 to provide a uniform homogeneous mixing of the color dye throughout the cement/water slurry before being discharged into the mixing auger 42. Since the high speed agitation of the cement and water causes a substantial dispersion of the agglomerated cement particles and an infusion of the cement particles into the water particles to create a more homogeneous slurry mixture than heretofore known, some admixtures will be activated more completely than heretofore known and may be reduced or even eliminated completely, particularly those admixtures used to decrease set time and increase compressive strength.

The utilization of a turbine mixer 50 to pre-mix the cement and water components for the production of concrete, particularly in mobile concrete production systems may require a change in the current standards by which concrete is now made. One skilled in the art will recognize that the principles of the instant invention are not limited in scope to only mobile concrete production systems, although the use of the turbine mixer 50 is highly advantageous in such an environment, the turbine mixer 50 can also be utilized in conventional batch production operations to increase the hydration of individual cement particles and to provide the advantages identified above. In fact, the utilization of the turbine mixer 50 in batch, or ready-mix, concrete production operations can completely revolutionize the entire concrete production industry. Tests have shown that concrete made with the cement and water pre-mixed by a turbine mixer 50 has approximately 15-20% greater compressive strength than corresponding conventionally prepared concrete. As a result, less cement would be required to provide concrete with the same strength specifications, providing a production cost savings.

The utilization of the turbine mixer for the batch or ready-mix concrete industry will require a larger turbine mixer structure than the representative structure shown and described above in conjunction with a mobile concrete production system. The principles of operation will be essentially identical for all types of concrete production except that the larger the size of the turbine mixer, the more power will be required to operate it.

It will be understood that changes in the details, materials, steps and arrangements of parts which have been described and illustrated to explain the nature of the invention will occur to and may be made by those skilled in the art upon a reading of this disclosure within the principles and scope of the invention. The foregoing description illustrates the preferred embodiment of the invention; however, concepts, as based upon the description, may be employed in other embodiments without departing from the scope of the invention.

What is claimed is:

1. A method of making concrete comprising the steps of:

introducing a supply of cement into a turbine mixer having a mixing member rotatably supported within a mixing chamber;

adding water into said mixing chamber to be combined with said cement;

rotating said mixing member at a rate of speed to break-up said cement and said water into fine particles to enhance the hydration of the cement particles and create a cement paste;

discharging said cement paste from said mixing chamber; and combining said cement paste with aggregate to form a concrete mixture.

2. The method of claim 1 wherein said mixing member divides said mixing chamber into an inner chamber and an outer chamber, said rotating step including the steps of:

agitating said cement and said water in said inner chamber with agitating fins mounted on said mixing member; and entraining air into said cement paste.

3. The method of claim 2 further comprising the steps of:

passing said cement paste through an annular gap between said mixing member and said mixing chamber to move said cement paste from said inner chamber to said outer chamber; and further agitating said cement paste with additional agitating fins in said outer chamber to entrain air therein.

4. The method of claim 3 wherein said turbine mixer is mounted on a mobile concrete production machine carrying said supplies of cement, water and aggregate, said combining step including the steps of:

conveying said cement paste from said mixing chamber; and combining said cement paste with said aggregate in a mixer auger located remotely from said turbine mixer.

5. The method of claim 1 wherein said rotating step rotates said mixing member at a rate of speed greater than 500 revolutions per minute.

6. The method of claim 1 further comprising the step of adding at least one admixture into said mixing chamber to be mixed into said cement paste before said discharging step.

7. The method of claim 1 further comprising the step of positionally adjusting a discharge port in said mixing chamber from which said cement paste is discharged to effect a desired amount of mixing of said cement and said water.

8. In a method of making concrete in which cement, water and aggregates are mixed to form a concrete mixture, the improvement comprising:

pre-mixing the cement and water in a mixing apparatus that breaks up cement and water with a turbine into small particles to infuse the cement particles into the water particles and create a cement slurry; and discharging the cement slurry from the mixing apparatus and combining said cement slurry with said aggregates creating said concrete mixture.

9. The method of claim 8 wherein said pre-mixing step includes the step of:

rotating said mixing apparatus at a high speed in a turbine mixer that receives said cement and said water to be combined therein.

10. The method of claim 9 further comprising the step of:

metering the inflow of cement into the turbine mixer.

11. The method of claim 10 wherein said mixing apparatus is mounted in a mixing chamber in a manner to divide the mixing chamber into an inner chamber and an outer chamber, said pre-mixing step further including the steps of:

introducing said metered inflow of cement into said inner chamber through an inlet opening;

adding said water into said inner chamber through an inlet port; and agitating said cement and said water in said inner chamber with agitating fins mounted on said mixing apparatus.

12. The method of claim 11 wherein said agitating step includes the step of:

entraining air into said cement paste.

13. The method of claim 11 wherein said pre-mixing step further includes the steps of:

passing said cement paste through an annular gap between said mixing apparatus and said mixing chamber to move said cement slurry from said inner chamber to said outer chamber; and further agitating said cement paste with additional agitating fins in said outer chamber; and said discharging step including the discharge of said cement slurry from said outer chamber.

14. The method of claim 13 wherein said rotating step rotates said mixing apparatus at a rate of speed greater than 500 revolutions per minute.

15. The method of claim 11 further comprising the step of adding at least one admixture into said mixing chamber to be mixed into said cement slurry before said discharging step.

16. The method of claim 11 further comprising the step of positionally adjusting a discharge port on said mixing chamber from which said cement slurry is discharged to vary a desired amount of mixing of said cement and said water in said mixing chamber.

17. A method of pre-mixing cement and water for the production of concrete, comprising the steps of:

introducing a supply of water and a supply of cement into a turbine mixer;

atomizing said supplies of water and cement within said turbine mixer to infuse cement particles into water particles and create a cement slurry;

discharging said cement slurry from said turbine mixer and combining said slurry subsequently with aggregate to produce concrete.

18. The method of claim 17 wherein said atomizing step includes the steps of:

rotating a mixing plate within said turbine mixer at speeds greater than 500 revolutions per minute, said mixing plate having agitating fins mounted thereon for engaging said cement particles and said water particles.

19. The method of claim 17 wherein said turbine mixer includes a housing defining a mixing chamber divided into an inner chamber and an outer chamber by a mixing plate having agitating fins mounted thereon, said atomizing step including the steps of:

rotating said missing plate at a rate of speed to break-up said supplies of cement and water into said cement particles and said water particles to enhance the hydration of the cement particles and create a cement slurry to combine said water and cement particles in said inner chamber with a first group of said agitating fins to create said cement slurry;

passing said cement slurry through an annular gap between said mixing plate and said housing to move said cement slurry from said inner chamber to said outer chamber; and further agitating said cement paste with an additional group of said agitating fins in said outer chamber to entrain air into said cement slurry.

20. The method of claim 19 wherein said introducing step includes the step of:

metering an inflow of said supply of cement into said inner chamber, said discharging step directing said cement slurry from said outer chamber.

* * * * *